United States Patent [19]

McGee et al.

[11] Patent Number: 4,631,210

[45] Date of Patent: Dec. 23, 1986

[54] LIQUID-CONTAINING DECORATIVE DEVICE

[75] Inventors: Theodore W. McGee, 2810 W. Logan Blvd., Chicago, Ill. 60647; Charles Muncy, St. Louis County, Mo.; John E. Suerth, Glenview, Ill.

[73] Assignee: Theodore W. McGee, Chicago, Ill.

[21] Appl. No.: 764,772

[22] Filed: Aug. 12, 1985

[51] Int. Cl.[4] ..... B44C 5/04

[52] U.S. Cl. ..... 428/13; 40/406; 156/61; 156/93; 272/8 N; 428/79; 428/102

[58] Field of Search ..... 40/406; 272/8 N, 27 N; 428/13, 46, 79, 102, 913.3, 914, 15; 156/61-93; 446/267; D2/208, 209, 212, 214, 215; D33/9 C, 9 D, 9 E, 9 R; D20/11

[56] References Cited

U.S. PATENT DOCUMENTS

| | | | |
|---|---|---|---|
| Re. 28,469 | 7/1975 | Impullitti | 8/139 X |
| 2,141,760 | 12/1938 | Mould | 428/13 X |
| 2,315,240 | 3/1943 | Ashenberg et al. | 428/913.3 X |
| 2,986,743 | 6/1961 | Eilen | 428/13 X |
| 3,055,133 | 9/1962 | Anderson | 428/13 X |
| 3,271,486 | 9/1966 | Dunlop | 272/8 N X |
| 3,310,130 | 3/1967 | Freet | 428/913.3 X |
| 3,438,062 | 4/1969 | Dobell | 428/79 X |
| 3,873,485 | 3/1975 | Fichera | 524/612 |
| 4,032,687 | 6/1977 | Hornsby, Jr. | 428/79 X |
| 4,057,921 | 11/1977 | Ball | 40/406 |
| 4,223,045 | 9/1980 | Fink | 426/532 X |
| 4,250,398 | 2/1981 | Ellis et al. | 428/323 X |
| 4,283,011 | 8/1981 | Spector | 428/79 X |
| 4,427,472 | 1/1984 | Trager | 428/914 X |
| 4,470,523 | 9/1984 | Spector | 428/40 X |
| 4,584,255 | 4/1986 | Remley | 430/537 X |
| 4,586,280 | 5/1986 | Dane | 446/267 X |

*Primary Examiner*—Henry F. Epstein
*Attorney, Agent, or Firm*—Kalish & Gilster

[57] ABSTRACT

A decorative device for application upon the exterior of an article of wearing apparel; the device comprising first and second sheets of transparent fluid impervious flexible material in registering relationship and being mutually secured in their marginal zones for jointly defining a central chamber. The decorative device is secured directly to the article of wearing apparel as by stitching and with there being a liquid of predetermined coloration and either of foaming or nonfoaming character partially filling the chamber for exception through the walls of said device. The liquids utilized are of predetermined formulation to possess the capacity to foam or otherwise so that upon movement of the wearer of the article of wearing apparel the liquid will be caused to flow within the confined chamber.

17 Claims, 7 Drawing Figures

LIQUID-CONTAINING DECORATIVE DEVICE

BACKGROUND

This invention relates broadly to wearing apparel and, more particularly, to a liquid-containing decorative device for securement upon articles of wearing apparel for purposes of ornamentation.

Heretofore, various expedients had been considered for providing decorative devices for application upon shirts, jackets, vests, and the like. Examplary of such earlier expedients are the picture pockets shown in the Anderson U.S. Pat. No. 3,055,133 wherein pockets of thin, clear, pliable, plastic sheet material are affixed to a garment and adapted for receiving a card or the like carrying a picture for viewing therethrough.

The Eilen U.S. Pat. No. 2,986,743 discloses a variation on a garment pocket designed to receive a picture, photograph or the like for viewing through a window portion.

The Dobell U.S. Pat. No. 3,438,062 discloses an interchangeable patch-pocket for securement upon a garment and with such member carrying an applied design.

The prior art is devoid of the provisions of a closed, pocket-forming decorative device which carries a predetermined amount of liquid therein for application upon wearing apparel. This broad concept is shown in designs of a form of the invention forming the subject matter of pending design patent applications, Ser. Nos. 578,436 filed Feb. 9, 1984 upon "Sweat Shirt" and 684,110 filed Dec. 20, 1984 upon "Sweat Shirt With Beer Mug".

Accordingly, it is an object of the present invention to provide a liquid-containing decorative device for application upon articles of wearing apparel and the like which is adapted to be affixed in a multiplicity of manners so as to preserve the integrity of the supporting article.

It is another object of the present invention to provide a decorative device of the character stated which may be mounted immediately and directly upon the article of wearing apparel by various methods which may be readily accomplished in a highly economical and rapid fashion, being thus conducive to high volume production.

It is a further object of the present invention to provide a device of the character stated which may be of any preselected design character so as to provide marked versatility; and wherein the contained liquid may be either of foaming or non-foaming character.

It is a still further object of the present invention to provide a device of the character stated wherein the formulation for the contained liquids, whether of foaming or non-foaming character, are readily blended without the utilization of costly equipment and without concern as to ambient conditions.

It is another object of the present invention to provide a device of the character stated which, in addition to presenting attractive ornamentation to the supporting article of wearing apparel, also provides a source of fascination to the viewer by reason of the responsive movement of the liquid to the physical action of the wearer; which device is extremely durable and reliable in usage, being constructed of sturdy, wear-resistant material, to the end that the same will possess a longevity at least coincident with that of the supporting article, and which device may be produced in a economical and rapid fashion, but without prejudice to the integrity of the structure thereof.

DESCRIPTION OF THE PREFERRED EMBODIMENT

Figure 1:
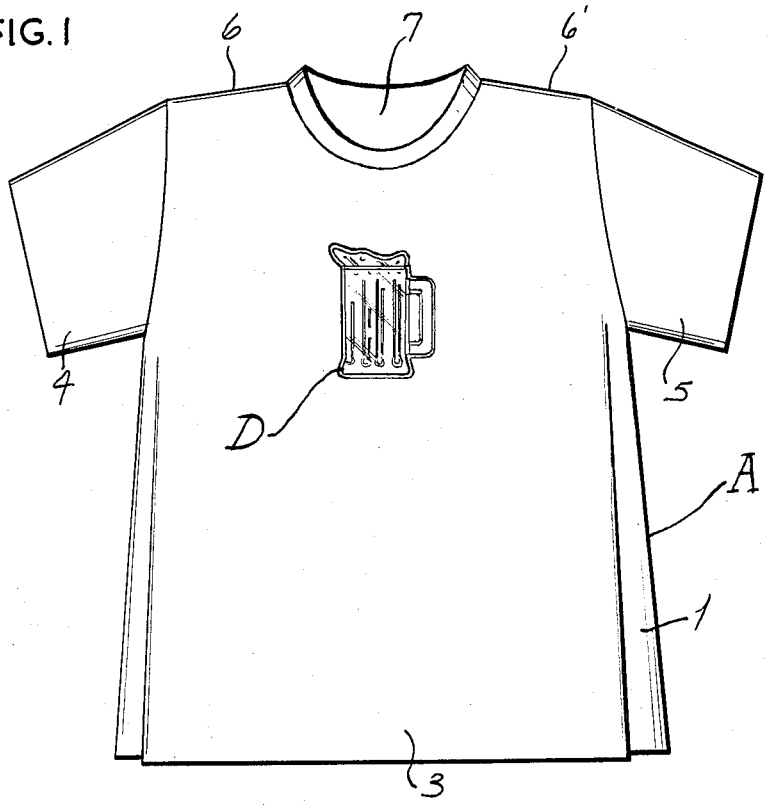
FIG. 1 is a front view of a garment in the nature of a short-sleeved shirt having applied thereon a decorative device constructed in accordance with and embodying the present invention.
Figure 3:
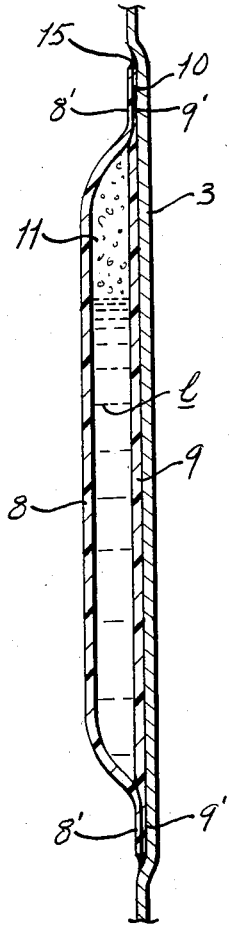
FIG. 3 is a vertical transverse sectional view taken on the line 3—3 of FIG. 2.
Figure 2:
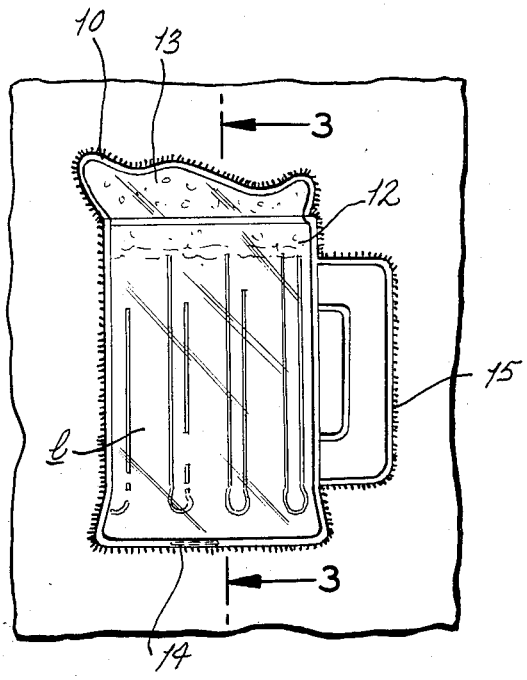
FIG. 2 is an enlarged front view of the decorative element illustrated in FIG. 1.

Referring now to FIGS. 1-3, inclusive, by reference numerals and characters, A designates a garment which for illustrative purposes constitutes a short-sleeve shirt, more popularly referred to as a T-shirt, fabricated of suitable material, whether synthetic fibers, natural fibers, or combinations thereof, comprising a body 1 having a front panel 3 and a rear panel (not shown) which are suitably secured along the usual side seams (not shown) with there being formed in the upper side portions of said panels arm holes for receiving the usual short sleeves 4, 5. Said front and rear panels at their upper ends are secured along shoulder seams as at 6, 6' and with said panels cooperating to define a neck opening 7. It is thus to be understood that garment A is described for exposition purposes of a multiplicity of other garments or adapted for use with the present invention, all as will become more apparent from the following.

Provided for securement upon garment A, understandably desirably the front panel 3 thereof is a decorative device D which may depict any desired object but which for demonstration, in this instance, constitutes the replica of a filled beer mug. Said device D comprises a pair of outer and inner sheets 8, 9, respectively, of flexible transparent, fluid impervious character, as formed of a suitable plastic such as polyvinyl, which contain registering marginal portions as at 8', 9', respectively, which are intimately mutually secured as by sealing, such as through R.F. welding, as indicated at 10. Thus, inwardly of the respective margins sheets 8 and 9 coact to form an enclosed volume or pocket 11. As indicated above, said sheets 8 and 9 have been suitably imprinted as at 12 to depict a beer mug and it will thus be noted that the line of sealing 10 is established so that pocket 11 will conform to the depicted mug, and with an air space 13 thereabove.

In formation of device D during the marginal sealing operation a portion of said margin is left unsealed so as to create a filler opening, as at 14. Said opening is of adequate character to permit the entry of liquid 1 into pocket 11 while allowing for appropriate escape of replaced air. However, immediately prior to the liquid filling operation, air under pressure is introduced into pocket 11 so as to effect a maximum expanded volume between the inner faces of front and rear sheets 8, 9 to bring about the formation of pocket 11. Thereupon the particular liquid 1 is introduced into the pocket 11, and with the same being filled to the extent desired. Said filling action is preferably effected gravitationally. With the beer mug, the pocket 11 will be filled to an extent to leave an unfilled or air containing portion, as at 13. After the filling operation, the opening 14 is then closed by sealing or welding action.

The now fully completed, liquid-containing decorative device is fixedly attached to front panel 3 of garment 1 by a line of welding or heat sealing as indicated at 15, thereby securing decorative element D fixedly and reliably upon the garment front panel 3.

It will thus be seen that with this particular decorative device D being in the form of a beer mug the liquid does not completely fill the pocket 11 so that upon bodily movement of the wearer of garment A the liquid as at 1 is free to flow in accordance with gravity and thus impart a sense of independent movement to a viewer as well as to enhance the formation of a foam simulative airy portion within the normally upper section of pocket 11. The particular liquid l utilized in the decorative device shown in FIGS. 1–3 is adapted for providing a foam-like characteristic so as to add an element of realism to the liquid contents. Formulations for such liquids are set forth and described more fully hereinbelow. Thus in accordance with the foregoing, it will be seen that decorative element D provides a very novel and attractive accessory to an article of wearing apparel, whether it be an outer body garment, headwear or the like, constituting a source of fascination. It is apparent that the particular decorative device utilized may be of such a character as to contain a liquid having a coloration which pleasingly blends in with the supporting garment.

Figure 4:
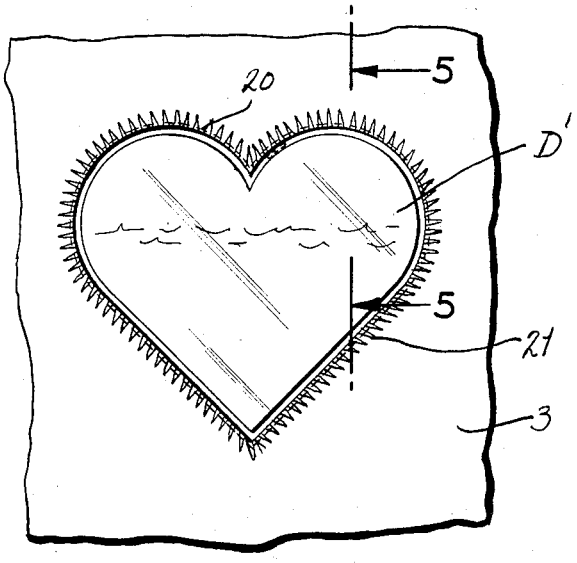
FIG. 4 is an enlarged front view of another form of decorative element for garments constructed in accordance with and embodying the present invention illustrating the same in mounted condition.
Figure 5:
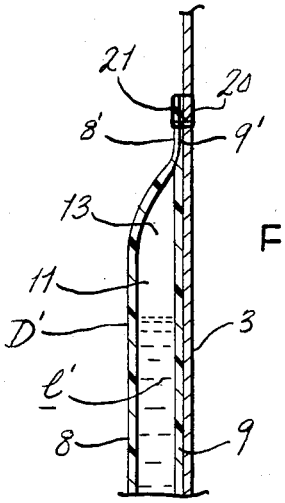
FIG. 5 is a fragmentary vertical transverse sectional view taken on the line 5—5 of FIG. 4.

Referring now to FIG. 4, another form of decorative element D′ is illustrated which is made in accordance with the present invention for application upon any suitable article of wearing apparel. In describing this form of the invention like numerals will be utilized for indicating corresponding components of the structure described hereinabove in connection with the embodiment illustrated in FIGS. 1–3, inclusive.

Thus, with this second form of the invention it will be seen that the flexible, fluid impermeable, transparent front and rear sheets 8, 9 are contoured to present a heart shaped design and forming a pocket 11 which has been suitably expanded under air pressure and being supplied with a liquid l′ which in this instance may be of a reddish color as characteristically utilized with heart simulative designs. It will be seen that the pocket 11 is only partially filled so as to leave an air space 13 permitting the liquid l′ to flow about said pocket 11 responsive to the bodily movements of the garment wearer. The marginal portions 8′, 9′ of front and rear panels 8, 9, respectively, are secured by a continuous line of stitching 20 which thereby assures of reliable union of sheets 8 and 9 for pocket formation. The decorative device D′ is then secured to thc front panel 3 of the garment A as by a second line of stitching 21 being of zig-zag pattern and being continuous about the marginal portions 8′, 9′ in overlying relationship to line of stitching 20, with such line of stitching 21 being in overcast relationship to said stitching 20, which thus effects an edge finishing as well as an effective means of securement.

It is, of course, apparent that the liquid l′ within decorative device D′ could be of foaming character but is described herein as being otherwise for purposes of demonstrating the versatility of the present invention.

Figure 6:
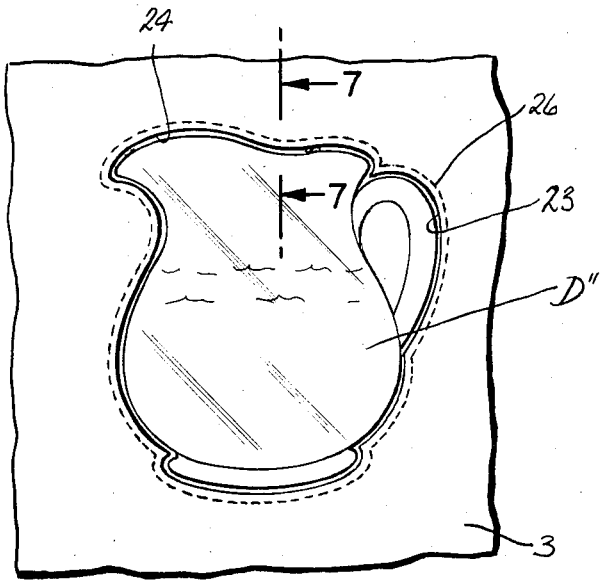
FIG. 6 is a front elevational view of a further form of decorative element for garments constructed in accordance with and embodying the present invention, illustrating the same in mounted condition.
Figure 7:
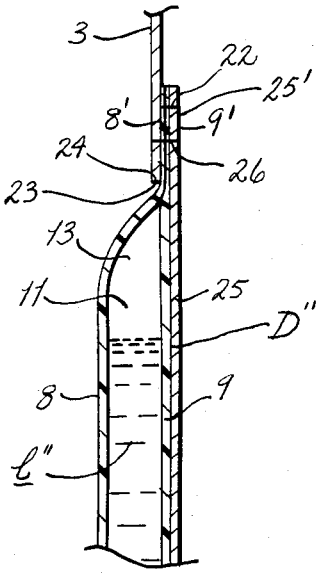
FIG. 7 is a fragmentary vertical transverse sectional view taken on the line 7—7 of FIG. 6.

Referring now to FIGS. 6 and 7, a still further form of decorative device indicated at D″ is illustrated which embodies the present invention. It will be understood, of course, that the same reference numerals and characters will be utilized with respect to FIGS. 6 and 7 as with respect to the embodiments shown in FIGS. 1, 2, 3 for purposes of facilitating comprehension.

Decorative device D″ is formed of front and back sheets 8, 9 which are related as in the structure shown in FIG. 3 for forming a pocket 11; with the respective marginal portions 8′, 9′ being secured by a continuous line of stitching 22. Said pocket 11 contains a liquid l″ which has been introduced into pocket 11 in the same manner as discussed with respect to decorative device D hereinabove set forth and with the pocket being only partially filled so as to provide an air space 13 which will allow the liquid l″ to flow within its confines responsive to movement of the wearer and thus, expectedly, present, in certain positions, the simulation of liquid being poured from the pitcher depicted.

With this form of the invention front panel 3 of garment A is provided with an aperture 23 which is contoured for correspondence with the configuration of the associated decorative device D″ so that the same is thus, as it were, set within aperture 23 with the surrounding aperture edge portions 24 thus forming a complementary frame about decorative device D′. The stitched marginal portions of decorative device D″ will accordingly be located rearwardly of the aperture edge portions 24 and thus aesthetically obscured from view (see FIG. 7). A section of fabric 25 corresponding to the fabric of front panel 3 is presented against the rearward face of decorative device D′ and being of such dimensions so as to fully cover same and having edge portions 25′ overlying the secured marginal areas of decorative device D′ (see FIG. 7). The said fabric section 25 is secured in such disposition by a line of stitching 26 to both the marginal portions of decorative device D′ and front panel 3, spacedly from aperture 23. Thus, the marginal portions of decorative device D′ are sandwiched between fabric section 25 and front panel 3. In view of the transparency of the sheets 8, 9 of decorative device D″, the viewer will be presented, as through the air space 13 of pocket 11 with pleasing and unusual effect by reason of the identity of fabric.

Accordingly, the foregoing demonstrates but 3 embodiments of the present invention, demonstrating means and methods for forming the decorative devices and for means of attachment to articles of wearing apparel. At the risk of repetition, it should be pointed out that the beer mug, heart, and pitcher characters of the decorative devices illustrated are merely exemplary since it will be appreciated that the number of different designs that could be utilized with the present invention are myriad. Furthermore, the decorative devices are suitable for application upon, or securement to, or within, a most extensive line of articles of wearing apparel, including, merely by way of example, jackets, skirts, shirts, sweaters, caps and other headwear and sportswear of all types, whether for hot weather or cold weather usage, etc.

The liquids, such as l, l′, and l″, as utilized with decorative devices of the present invention may be of foaming or non-foaming character depending upon the motif of the particular decorative device. Considering initially the liquids of the foaming character, such as indicated at l in the embodiment illustrated in FIGS. 1–3, inclusive, it has been found that the same will essentially comprehend surfactants of two particular species, namely, those which have high foaming properties and those which coact therewith for foam stability. Also incorporated in such liquids is a biostatic agent and coloring agents including food dyes to provide the particular color and shade desired, together with water constituting the balance. These ingredients may be readily blended and intermixed so that the liquid may be prepared in a most economical and rapid fashion. The preparation of the foaming liquid is achieved under ambient conditions and without the necessity of any complex equipment so that there need not be any concern relative to temperature, humidity, atmospheric pressure and the like. The biostat and a major portion of the water are mixed and the various surfactants are sequentially introduced into the solution with each one being stirred until clear; the coloring agents are then added and the remaining necessary amount of water added.

A general formulation for such liquids would be as follows:

| | BY VOLUME |
|---|---|
| Biostat | Approx. 5%–10% |
| High Foaming Surfactants | Approx. .055%–.6% |
| Foam Stability Surfactants | Approx. .03%–.3% |
| Coloring Agents | To extent desired. |
| Foam Enhancing Agents | .05%–.2% |
| Water | q.s. |

Examplary of such a preparation suitable for preparing the liquid for the decorative device constituting a beer mug is as follows:

| | BY VOLUME |
|---|---|
| Propylene Glycol | Approx. 5%–10% |
| Makon 10* | Approx. .01%–.1% |
| Steol CS460** | Approx. .02%–.2% |
| Ninol 128X*** | Approx. .025%–.3% |
| Bioterge AS40**** | Approx. .02%–.2% |
| NF12***** | Approx. .01%–.1% |
| Sugar | Approx. .05%–.2% |
| Beer Color (Burnt Caramel) | q.s. |
| Yellow Food Dye | q.s. |
| Water | q.s. |

Each of the ingredients identified below are products of Stepan Chemical Co. of Northfield, Illinois.
*Makon 10. Ethoxylated Nonylphenol (containing 9½–10 moles of ethylene oxide).
**Steol CS460. Sodium Fatty Alcohol.Ether Sulfate ($c_6$–$c_{14}$ Alcohol).
***Ninol 128X. Coconut Oil Diethanol Amide.
****Bioterge AS40. Sodium Alpha-Olefin Sulfonate ($c_{14}$–$c_{16}$ Aliphatic Chain).
*****NF12. Alkoxylated Fatty Alcohol ($c_{10}$–$c_{12}$ Alcohol).

In the foregoing, it will be seen that the propylene glycol serves as a biostat while Makon 10, Steol CS460 and Ninol 128X are high foaming surfactants while Bioterge AS40 and NF12 are foam stabilizing surfactants with such foam stability being enhanced by the sugar. The coloring agent and dye ae added to such extent as to provide a coloration which, to the eye, approximates that desired, simulating the real fluid involved. Thus, by the use of the foregoing formulation, a constant foam is provided and which will be temporarily enhanced by agitation of the liquid brought about through the movement of the wearer of the garment.

It is, of course, quite apparent that the coloration is simply a matter of choice so that the particular coloring agents indicated in the immediately preceding formula are not of general criticality but merely illustrate the inclusion of the requisite agents for the particular color in question.

The non-foaming liquids, such as indicated at l′ and l″ in the drawings, are equally easily prepared. Effective liquids of this character would include a biostat, water, a wetting agent, a hydrotrope for solubilizing the wetting agent together with water and coloring material in sufficient quantity. A formulation useful for this purpose is exemplified by the following:

| | BY VOLUME |
|---|---|
| Propylene Glycol | Approx. 5%–10% |
| NF12 | Approx. .05%–.3% |
| Stepanate X* | Approx. .025%–1.5% |
| Coloring Agents | q.s. |
| Water | q.s. |

*Stepanate X, which is a product of Stephan Chemical Co. of Northfield, Illinois, is Sodium Xylene Sulfonate.

In preparing the non-foaming liquid, a substantial portion of the water and the propylene glycol which acts as a biostat are initially agitated. The Stepanate X is then added; the same being a hydrotrope or coupling agent, and which in the present instance acts to solubilize the wetting agent which in this instance is the alkoxylated fatty alcohol. This latter ingredient is in quantity to the point of just avoiding the development of any cloudiness. Should there be an excess introduced which causes cloudiness, then an additional amount of the hydrotrope may be added to eliminate such cloudiness. Thereafter, the particular coloring and water are added to complete the formulation.

As pointed out, the non-foaming solutions do not require the utilization of any complex instruments, only a device suitable for bringing about necessary agitation to facilitate solution formation and as indicated, the coloring agents may be of any type which are water soluble, the same being well within the knowledge of one having ordinary skill in the art.

Thus, the liquids useful with the decorative device of the present invention are cheaply and easily prepared whether of foaming or non-foaming character; and each of the former are adapted for foam stabilization so that this characteristic is not lost during usage.

What is claimed is:

1. A decorative device for use in conjunction with garments of natural or synthetic fabrics or combinations thereof comprising front and back normally flat sheets of transparent, fluid impervious, plastic material disposed in flatwise registering relationship, means securing said front and back sheets, one to the other, in the marginal zones thereof for developing a central chamber or volume therebetween, liquid provided within said chamber being of predetermined coloration for visual display through said front sheet, and means securing said marginally joined sheets upon the selected garment.

2. A decorative device as defined in claim 1 and further characterized by said sheets being secured to said selected garment by heat sealing the edge portions of said device to said garment.

3. A decorative device as defined in claim 2 and further characterized by said front and back sheets being mutually secured by heat sealing.

4. A decorative device as defined in claim 1 wherein said front and back sheets are mutually secured by a first line of stitching, and said means for securing same to the garment being a second line of stitching.

5. A decorative device as defined in claim 1 or claim 4 wherein the decorative device is presented directly upon the garment fabric, and with the chamber being partially liquid filled to provide an air-containing zone into which said liquid is free to flow subsequent to movement by the wearer of the garment.

6. A decorative device as defined in claim 5 wherein said liquid is of foaming character.

7. A decorative device as defined in claim 1 wherein the liquid comprises the following formulation:

| | BY VOLUME |
|---|---|
| Biostat | Approx. 5%-10% |
| Wetting Agent | Approx. .05%-.3% |
| Coupling Agent | Approx. .025%-1.5% |
| Coloring Agent | q.s. |
| Water | q.s. |

8. A decorative device as defined in claim 1 wherein the liquid comprises the following formulation:

| | BY VOLUME |
|---|---|
| Propylene Glycol | Approx. 5%-10% |
| Alkoxylated Fatty Alcohol | Approx. .05%-.3% |
| Sodium Xylene Sulfonate | Approx. .025%-1.5% |
| Coloring Agents | q.s. |
| Water | q.s. |

9. A decorative device as defined in claim 1 wherein the liquid is of foaming character and comprises:

| | BY VOLUME |
|---|---|
| Biostat | Approx. 5%-10% |
| High Foaming Surfactant (or combinations thereof) | Approx. .055%-.6% |
| Foam Stability Surfactant (or combinations thereof) | Approx. .03%-.3% |
| Foam Enhancing Agent | Approx. .05%-.2% |
| Coloring Agent | q.s. |
| Water | q.s. |

10. A decorative device defined in claim 1 wherein the liquid is of foaming character and has the following formulation:

| | BY VOLUME |
|---|---|
| Propylene Glycol | Approx. 5%-10% |
| Ethoxylated Nonylphenol | Approx. .01%-.1% |
| Sodium Fatty Alcohol Ether Sulfate | Approx. .02%-.2% |
| Coconut Oil Diethanolamide | Approx. .025%-.3% |
| Sodium Alpha-Olefin Sulfonate | Approx. .02%-.2% |
| Alkoxylated Fatty Alcohol | Approx. .01%-.1% |
| Sugar | Approx. .05%-.2% |
| Color | q.s. |

-continued

| | BY VOLUME |
|---|---|
| Water | q.s. |

11. A decorative device as defined in claim 6 wherein the color is comprised of burnt caramel and yellow food dye.

12. A decorative device for securement upon a garment of natural or synthetic fabrics or combinations thereof comprising front and back, normally flat sheets of transparent, fluid impervious, plastic material, means securing said front and back sheets, one to the other, in the marginal zones thereof for developing a central chamber or volume therebetween, liquid provided within said chamber, being of predetermined coloration, for visual display through said front sheet, the preselected garment having an opening for projection therethrough of the central portion of said decorative device, said device being of greater dimensions than said garment opening whereby the marginal portions of said device are disposed obscuredly inwardly of the edge portions of said garment opening, a section of material being of greater dimensions than said decorative device and said garment opening being located inwardly of said device in confrontation with the back sheet thereof for providing a background for the liquid-received device, the marginal portions of the device being sandwiched between the edge portions of the garment opening and of the section of material, means securing the garment, said sectional material, and the intervening marginal portions of said front and back sheets for maintaining said device in position.

13. A decorative device as defined in claim 12 wherein said securing means is stitching.

14. A decorative device as defined in claims 1 or 12 wherein said liquid within the chamber is of foaming character.

15. A method of providing a decorative device for securement upon a garment of natural or synthetic fabrics or combinations thereof comprising providing first and second sheets of flexible, transparent, fluid impervious, plastic material, presenting same in registering relationship, securing the confronting marginal portions of said sheets to each other for development of an internal chamber, withholding securing said sheets in a limited zone to provide an opening to permit liquid ingress into said chamber, applying air under pressure to said chamber through said opening for expanding said chamber, providing a liquid of predetermined coloration, introducing said liquid into said chamber through said opening for partially filling said chamber and thereby developing an air containing volume, closing said opening, and then securing said decorative device upon said garment with said liquid being enabled to flow commensurate with the air-conditioning volume of the chamber responsive to movement of the wearer, said liquid being fully visible through said device.

16. The method as defined in claim 15 and further characterized by said liquid containing foam producing agents so that upon movement of the wearer a foam appearing mass will develop within the normally air containing volume of said chamber.

17. The method as defined in claim 15 wherein said first and second sheets are marginally secured by heat welding and said decorative device is secured to the article of wearing apparel by stitching.

* * * * *